US008146323B1

(12) United States Patent
Tooman

(10) Patent No.: US 8,146,323 B1
(45) Date of Patent: Apr. 3, 2012

(54) APPARATUS AND METHOD FOR INSTALLING ANCHOR BOLTS IN A CYLINDRICAL PIER FOUNDATION

(76) Inventor: Norman L. Tooman, Bakersfield, CA (US)

( * ) Notice: Subject to any disclaimer, the term of this patent is extended or adjusted under 35 U.S.C. 154(b) by 0 days.

(21) Appl. No.: 13/104,283

(22) Filed: May 10, 2011

Related U.S. Application Data

(60) Provisional application No. 61/333,231, filed on May 10, 2010.

(51) Int. Cl.
*E02D 27/00* (2006.01)

(52) U.S. Cl. ..... 52/745.04; 52/742.15; 52/294; 52/297

(58) Field of Classification Search ..... 52/699, 52/713, 294–297, 741.15, 742.15, 745.04; 411/102
See application file for complete search history.

(56) References Cited

U.S. PATENT DOCUMENTS 3,571,991 A * 3/1971 Doocy et al. ..... 52/40
4,104,885 A * 8/1978 Thomas ..... 405/153
4,842,447 A * 6/1989 Lin ..... 405/243
5,586,417 A 12/1996 Henderson et al.
5,826,387 A 10/1998 Henderson et al.
7,533,505 B2 * 5/2009 Henderson ..... 52/292
7,618,217 B2 * 11/2009 Henderson ..... 405/255
7,805,895 B2 * 10/2010 Kristensen ..... 52/169.9
8,037,646 B2 * 10/2011 Wobben ..... 52/126.3
2002/0194794 A1 * 12/2002 Hill et al. ..... 52/40
2004/0098935 A1 * 5/2004 Henderson ..... 52/296
2007/0251187 A1 * 11/2007 Schiffer et al. ..... 52/741.14
2008/0155907 A1 * 7/2008 Wobben ..... 52/169.13
2009/0044482 A1 2/2009 Tooman
2009/0094927 A1 * 4/2009 Farrell, Jr. ..... 52/583.1
2011/0131899 A1 * 6/2011 Voss et al. ..... 52/173.1

* cited by examiner

*Primary Examiner* — William Gilbert
*Assistant Examiner* — Alp Akbasli
(74) *Attorney, Agent, or Firm* — James M. Duncan, Esq.; Klein, DeNatale, Goldner, et al.

(57) ABSTRACT

In a foundation for a wind turbine, the foundation has a large number of anchor bolts which are axially placed within the bore hole for mounting a tower flange of the wind turbine. In contrast to the practiced method, the present invention utilizes the fabrication of separate bolt packages, in which the bolts of each bolt package are configured to have an inner arc of bolts and outer arc of bolts, where each bolt in the bolt package is retained, by position retention means, in a fixed position with respect to the position of the other anchor bolts in the pre-assembled package. The present invention describes the position retention means for forming each pre-assembled package and a method of using the position retentions for constructing a foundation for a wind turbine.

20 Claims, 19 Drawing Sheets

APPARATUS AND METHOD FOR INSTALLING ANCHOR BOLTS IN A CYLINDRICAL PIER FOUNDATION

CROSS-REFERENCE TO RELATED APPLICATIONS

U.S. Provisional Application No. 61/333,231 for this invention was filed on May 10, 2010, for which application this inventor claims domestic priority.

BACKGROUND OF THE INVENTION

This invention relates to concrete foundations set within excavations or bore holes which are installed to support wind turbines. More particularly, this invention comprises an apparatus and method for configuring, installing, and setting the anchor bolts for a cylindrical foundation for a wind turbine prior to pouring the concrete.

U.S. Pat. Nos. 5,586,417 and 5,826,387, both by Henderson, disclose a foundation "which can be poured-on-site monolithically and is of cylindrical construction with many post-tensioned anchor bolts which maintain the poured portion of the foundation under heavy compression, even during periods when the foundation may be subject to high overturning moment." Henderson's foundation is preferably in the shape of a cylinder, having an outer boundary shell and an inner boundary shell each formed of corrugated metal pipe. Between the outer boundary shell and the inner boundary shell elongated high strength steel bolts extend vertically up through concrete from a peripheral anchor plate, called an inbed plate, located near the bottom of the cylinder. The bolts extend upwardly from the inbed plate to a connecting plate or flange above the ground surface. The bolts extend through hollow tubes to prevent adhesion of the concrete to the bolts. The foundation typically uses no rebar reinforcing steel. This design uses the mechanical interaction with the earth to prevent over turning instead of the mass of the foundation typically used by other foundations for tower structures. FIG. 1 schematically shows an embodiment of the Henderson foundation.

The "hollow tubes" of this foundation are typically elongated plastic tubes which encase the bolts substantially through the entire vertical extent of the concrete and allow the bolts to be tensioned after the concrete has hardened and cured, thereby post-tensioning the entire concrete foundation. Alternatively, the elongated bolts can be wrapped in plastic tape, or coated with a suitable lubrication, which will allow the bolts to stretch under tension over the entire operating length of the bolt through the vertical extent of the concrete.

Henderson further discloses the post-stressing of the concrete in great compression by tightening the high strength bolts to provide heavy tension between a heavy top flange and the inbed plate at the bottom of the foundation, thereby placing the entire foundation under high unit compression loading. The bolts are tightened so as to exceed the maximum expected overturning force of the turbine tower on the foundation. Therefore, the entire foundation withstands various loads with the concrete always in compression and the bolts always in static tension.

The tensioning bolts in the cylindrical foundation are preferably in side-by-side pairs, the pairs extending radially from the center of the foundation, forming an inner ring of bolts and an outer ring of bolts as shown in FIG. 2. As shown in FIG. 2, the inner ring of bolts has a slightly shorter diameter than the outer ring of bolts. The bolt pattern is, of course, determined by the bolt pattern on the mounting flange of the turbine tower to be installed on the foundation. A large number of bolts in typically used for this type of foundation. Typically seventy tensioning bolts are used in the inner ring and seventy tensioning bolts in the outer ring for a total of one hundred forty. In Henderson's foundation, the lower ends of the bolts are anchored to the inbed plate at the bottom of the foundation which may be constructed of several circumferentially butted and joined sections.

The following known procedure is typically followed in constructing the cylindrical foundation. A bore hole is drilled or excavated and an outer boundary shell of corrugated metal pipe ("CMP") is set within the hole. Bolt bundles are lowered into the borehole. The bolt bundles typically comprise about thirty bolts, with each bolt weighing up to two hundred pounds per bolt. Workers are lowered into the CMP lined bore hole. Working from the bottom of the bore hole, the workers lift and/or position each individual bolt so it can be inserted into a template at the surface, which is suspended above the bore hole by a crane having a capacity of approximately 100 tons. Once each bolt is inserted into the template, a nut made up onto the threads extending above the template, such that the weight of each bolt is suspended by the template.

Once all of the bolts have been suspended from the template, the entire assembly is lifted out of the bore hole so the inbed plates may be placed at the bottom end of the bolts. As the assembly is lowered back into the bore hole, bands or rebar wraps are placed around the collective bolts to hold the bolts in position during the pouring of the concrete. FIG. 3 shows such an assembly suspended by a lifting frame which is connected to the template. The entire assembly is then lowered back into the bore hole and an inner boundary shell of CMP is lowered into the bore hole such that the bolts are extending upwardly through the annulus formed by the outer boundary shell and the inner boundary shell. Concrete is poured into this annulus around the upwardly extending bolts, with the template at the top of the bolts used to form a "grout trough" in the upper surface of the concrete. The upwardly facing ends of the bolts extend into the grout trough and, following the hardening of the concrete, the grout trough is filled with a high strength grout upon which the tower flange is placed when the grout has adequately cured.

It is to be appreciated that the above-described procedure anticipates that a number of workers will be working below a very heavy assembly (i.e., the template with all of the suspended bolts) as shown in FIG. 3. After all of the bolts are hung from the template, the entire assembly, including the lifting frame, is very heavy, requiring the use of a crane having a lifting capacity of approximately 100 tons. This procedure has a number of disadvantages. For example, it requires a large number of workers working below a very heavy assembly, creating a potential safety hazard. It also requires a large number of personnel in the borehole to expeditiously hang the bolts from the template. A comparable number of personnel are required at the surface to install and tighten the nuts on the upwardly facing ends of the bolts. A large crane is required for lifting and suspending the bolt-template assembly.

SUMMARY OF THE INVENTION

Embodiments of the method and apparatus disclosed herein provide a solution to the disadvantages described above. For purposes of this disclosure, the phrase "downwardly facing end" when referencing a bolt refers to the end of a bolt facing downward within a bore hole and the phrase "upwardly facing end" refers to the end of a bolt facing upward within the bore hole.

An embodiment of the method first involves preparing a foundation bore hole according to Henderson or other method. The total number of tower flange bolts to be utilized for the foundation is divided into a plurality of groups. Each of the bolts is encased within a hollow tube or other encasement ("sleeve") which allows movement of the bolt relative to the sleeve once the bolt and sleeve are set within a concrete foundation. Each group of bolts is assembled into a bolt package where each bolt package comprises a plurality of bolts, where each bolt is either encased within a sleeve or wrapping to allow motion of the bolt with respect to the sleeve or wrapping. Within each bolt package, each bolt, is retained, by position retention means, in a position, with respect to the position of adjacent bolts, which is substantially the same position as when the bolt package is later placed within the foundation bore hole. The downwardly facing ends of the bolts of each bolt package are attached to an arc-shaped in-bed plate having holes for an inner arc of bolts and an outer arc of bolts. Each assembled bolt package may thereafter be individually placed within the bore hole. The bolt packages are arranged such that the inner arc of bolts of each anchor bolt package form an inner circle of upwardly facing anchor bolts and the outer arc of each bolt package form an outer circle of upwardly facing anchor bolts.

The number of bolts in each bolt package will generally be about ten to twelve bolts. Of course this number may vary according to various design and installation factors, without changing the basic concept of the embodiments of the method and apparatus disclosed herein. The installation of the above-described bolt packages eliminates the need for a large number of personnel inside the bore hole lifting each individual bolt so that the upwardly facing end of each bolt may be attached to a template. It further eliminates the need to lift the entirety of the bolts with the template as depicted in FIG. 3 so that the downwardly facing ends may be set within the anchor plates, because the anchor plates have already been installed in sections to each bolt package. The utilization of the position retention means for each bolt package eliminates the need for the placement of bands or rebar around the collective bolts to hold the bolts in position during the pouring of the concrete, because the position retention means accomplishes this purpose. As yet another benefit, the known method requires that each bolt be attached to the template with a nut in order for the bolt to be suspended by the template. Because the present method does not require the template to support the collective weight of all of the anchor bolts, a much lighter template may be utilized for the formation of the grout trough and not every bolt needs to have a nut attached to the template at the upwardly facing end of the bolt.

DETAILED DESCRIPTION OF THE EMBODIMENTS

Figure 1:
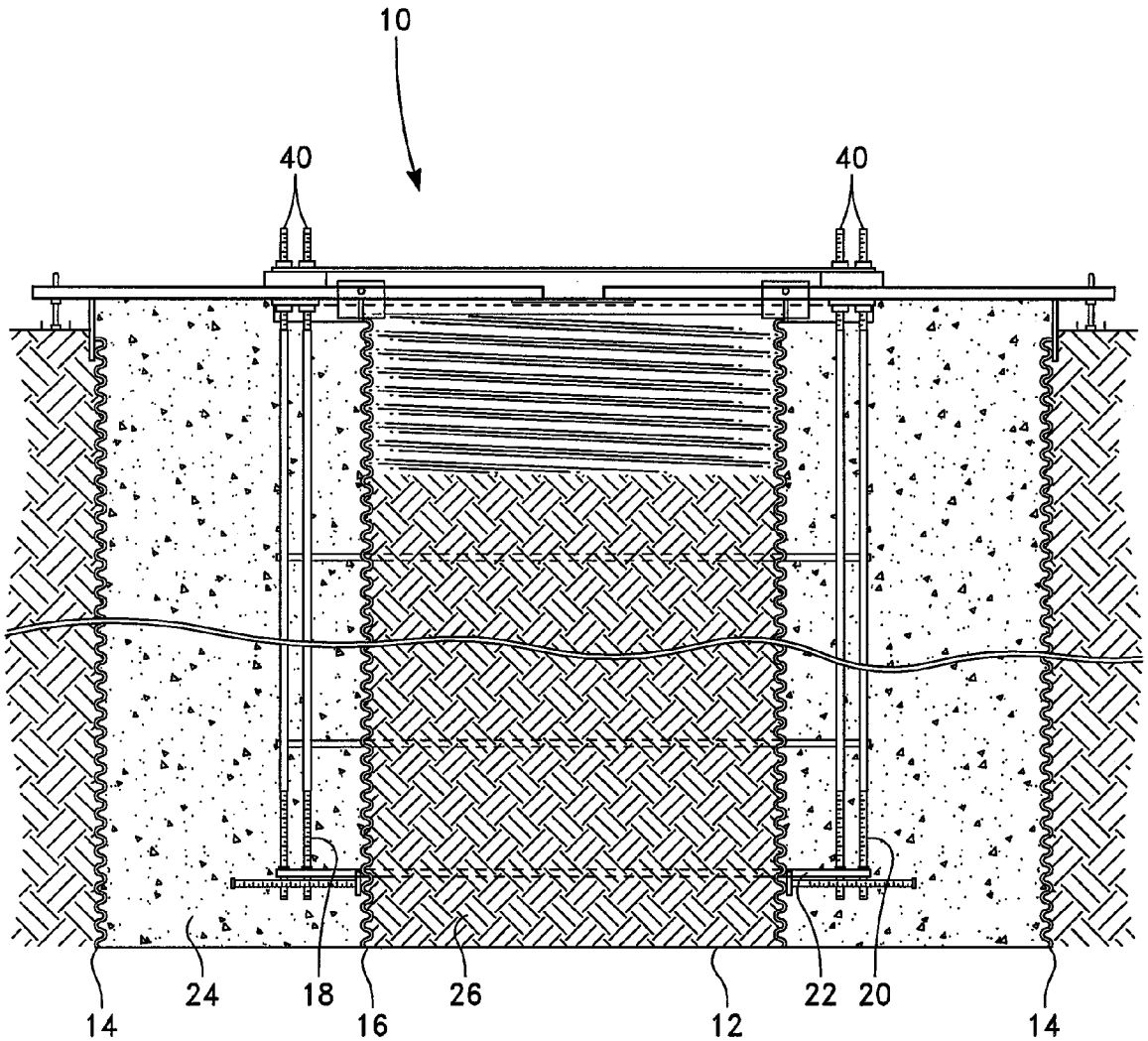
(Prior Art) FIG. 1
FIG. 1 shows the foundation of Henderson following installation of the anchor bolts.

Referring specifically to the figures, FIG. 1 depicts an embodiment of a known foundation 10 utilized for installation of a relatively tall vertical structure, such as a wind turbine. It is to be appreciated that while the disclosed method and apparatus may be utilized to obtain a foundation 10 such as that depicted in FIG. 1, the procedure for obtaining the foundation is entirely different from the known methods. Foundation 10 comprises a bore hole 12, an outer boundary shell 14 and an inner boundary shell 16, each typically fashioned of corrugated metal pipe ("CMP"), set within the bore hole hole. An inner ring 18 of bolts 40 and an outer ring 20 of bolts 40 are disposed within the annulus formed between the outer boundary shell 14 and the inner boundary shell 16, with the bolts 40 anchored at the lower end of the bore hole 12 to an inbed plate 22. The annulus between the outer boundary shell 14 and the inner boundary shell 16 is filled with concrete 24 and the portion of the bore hole 12 inside the inner boundary shell 16 typically filled with loosely compacted soil 26.

Figure 2:
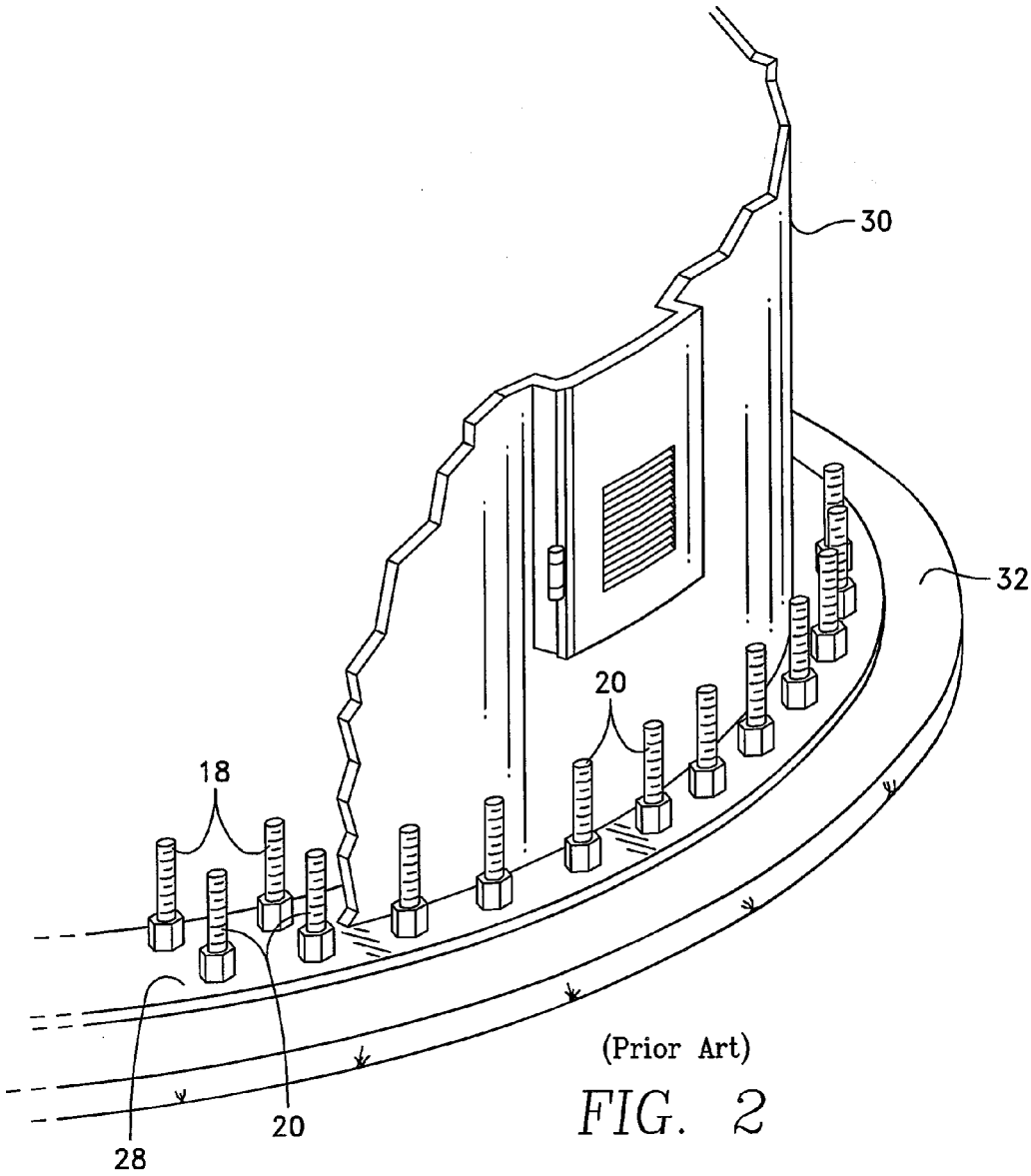
(Prior Art) FIG. 2
FIG. 2 shows a completed foundation, showing an inner ring of anchor bolts and an outer ring of anchor bolts with a tower flange attached.

FIG. 2 depicts a typical surface view of a wind turbine base, showing the inner ring 18 of bolts 40 and the outer ring 20 of bolts 40 extending through a base flange 28 of a wind turbine tower 30 set upon a base 32 formed by concrete 24.

Figure 3:
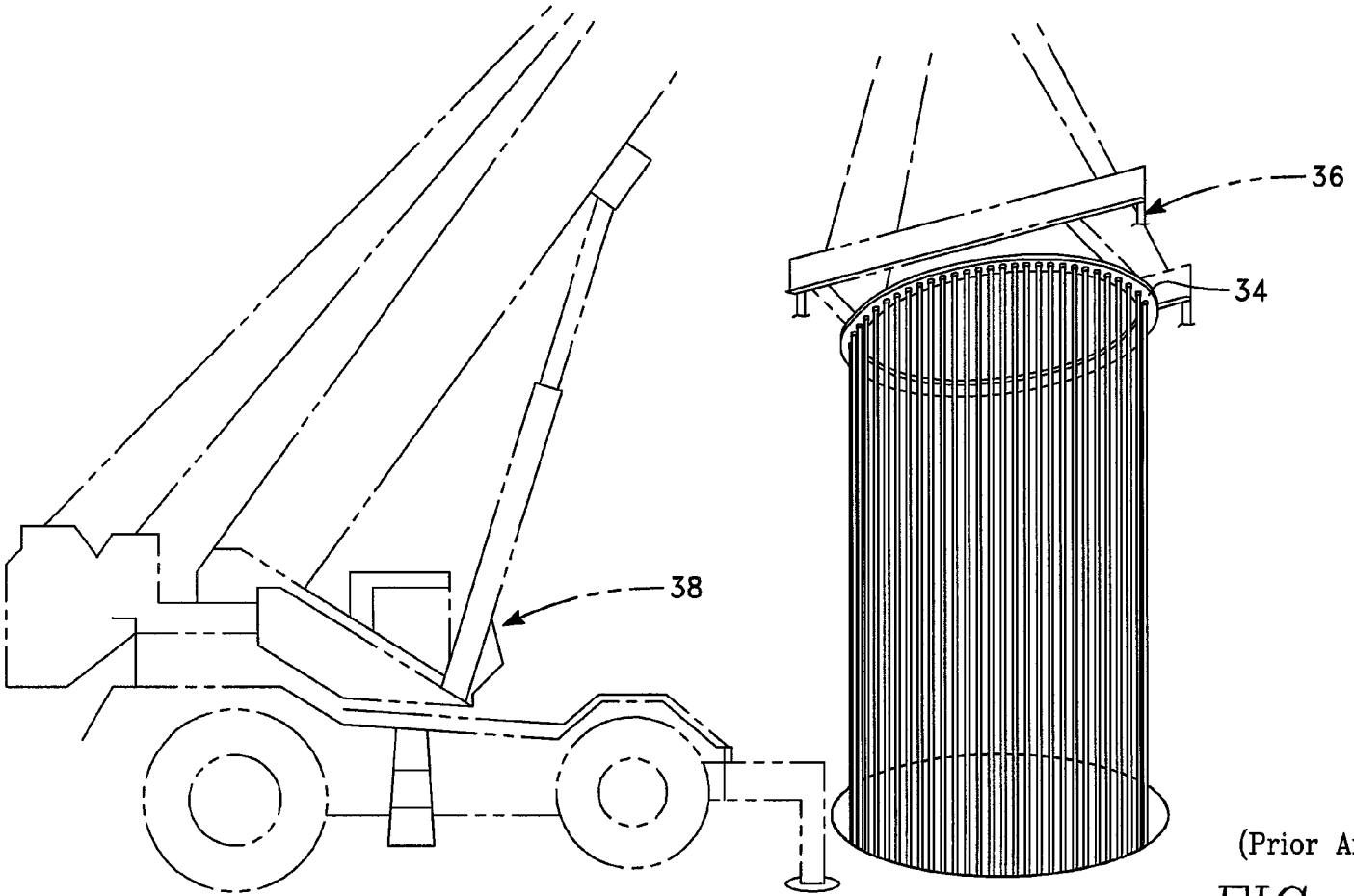
(Prior Art) FIG. 3
FIG. 3 shows the prior art method of placing the anchor bolts, where all of the anchor bolts are suspended from the template above the borehole.

FIG. 3 depicts the currently practiced method for obtaining the configurations depicted in FIGS. 1 and 2. As described above, a bolt assembly is formed by first lowering individual bolts 40 into bore hole 12, and then manually raising each bolt until it is attached to template 34. Once all of the bolts have been attached to template 34, the bolt assembly is lifted by a lifting assembly 36 connected to a high capacity crane 38.

Figure 4:
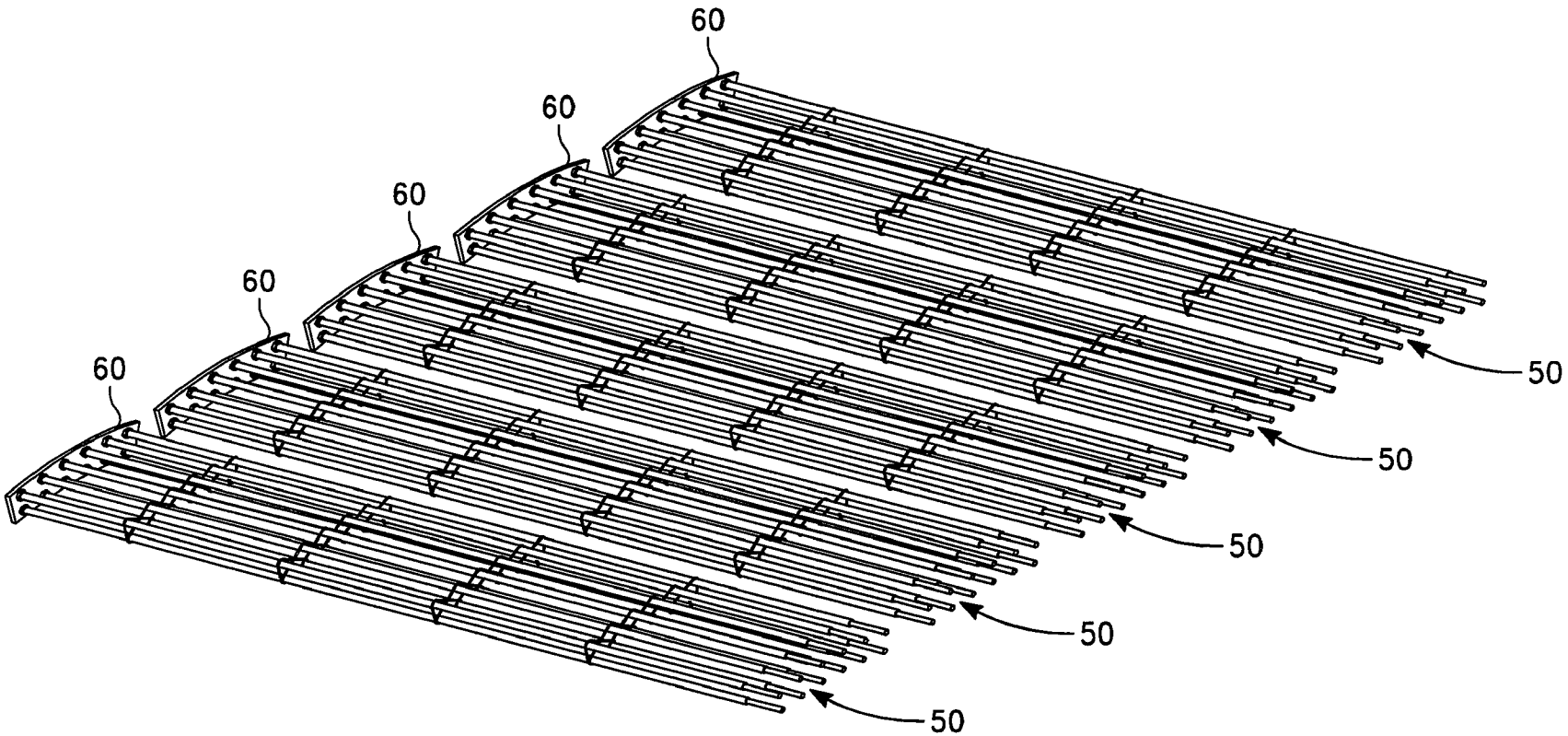
FIG. 4 shows a plurality of assembled bolt packages awaiting installation into the bore hole of a foundation.

The present invention is utilized to obtain the configurations depicted in FIGS. 1 and 2 but largely avoiding the method depicted in FIG. 3. The described method, and the apparatus utilized in the method, are substantially more efficient and safer than the currently practiced method. As with the known method, a bore hole 12 is drilled and lined with outer boundary shell 14. However, rather than transferring bolt bundles into the bore hole and lifting each individual bolt 40 and inserting the bolt into template 34 according to the known method, in the disclosed method prefabricated bolt packages 50 are assembled outside of the bore hole 12 as depicted in FIG. 4.

Figure 6:
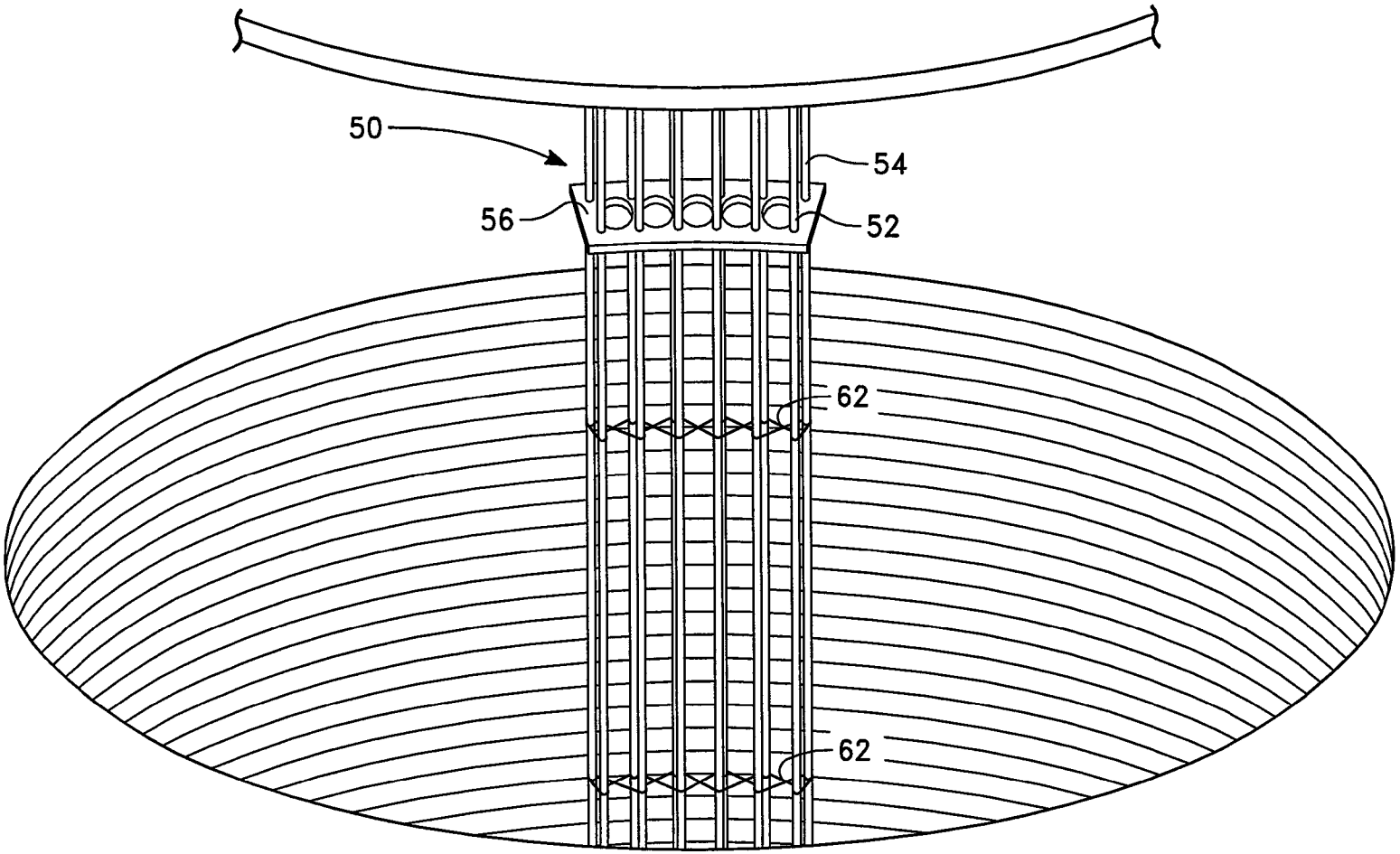
FIG. 6 depicts an embodiment of a bolt package being lowered into position within a bore hole.
Figure 7:
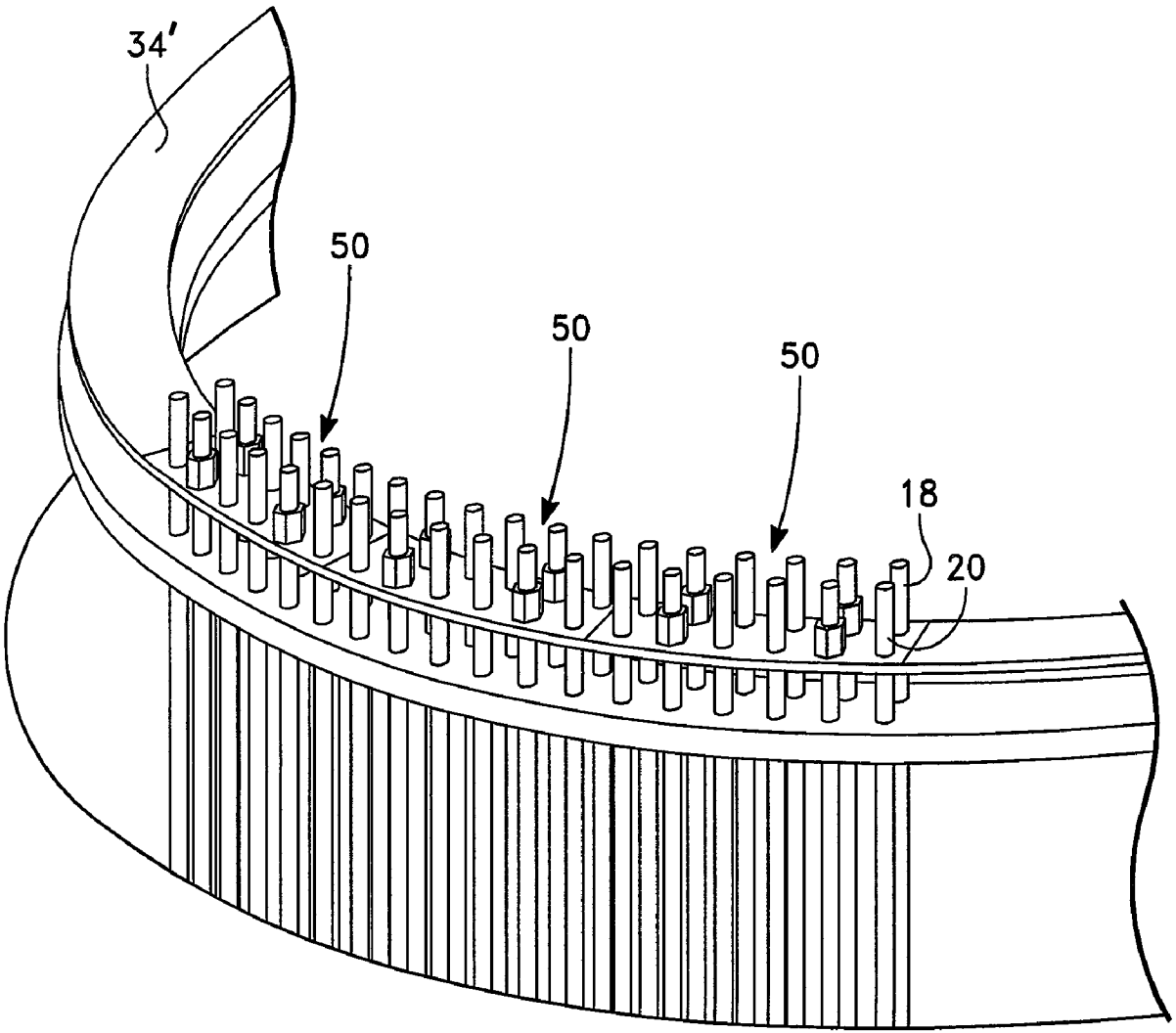
FIG. 7 shows the top of a borehole with several bolt packages installed.
Figure 8:
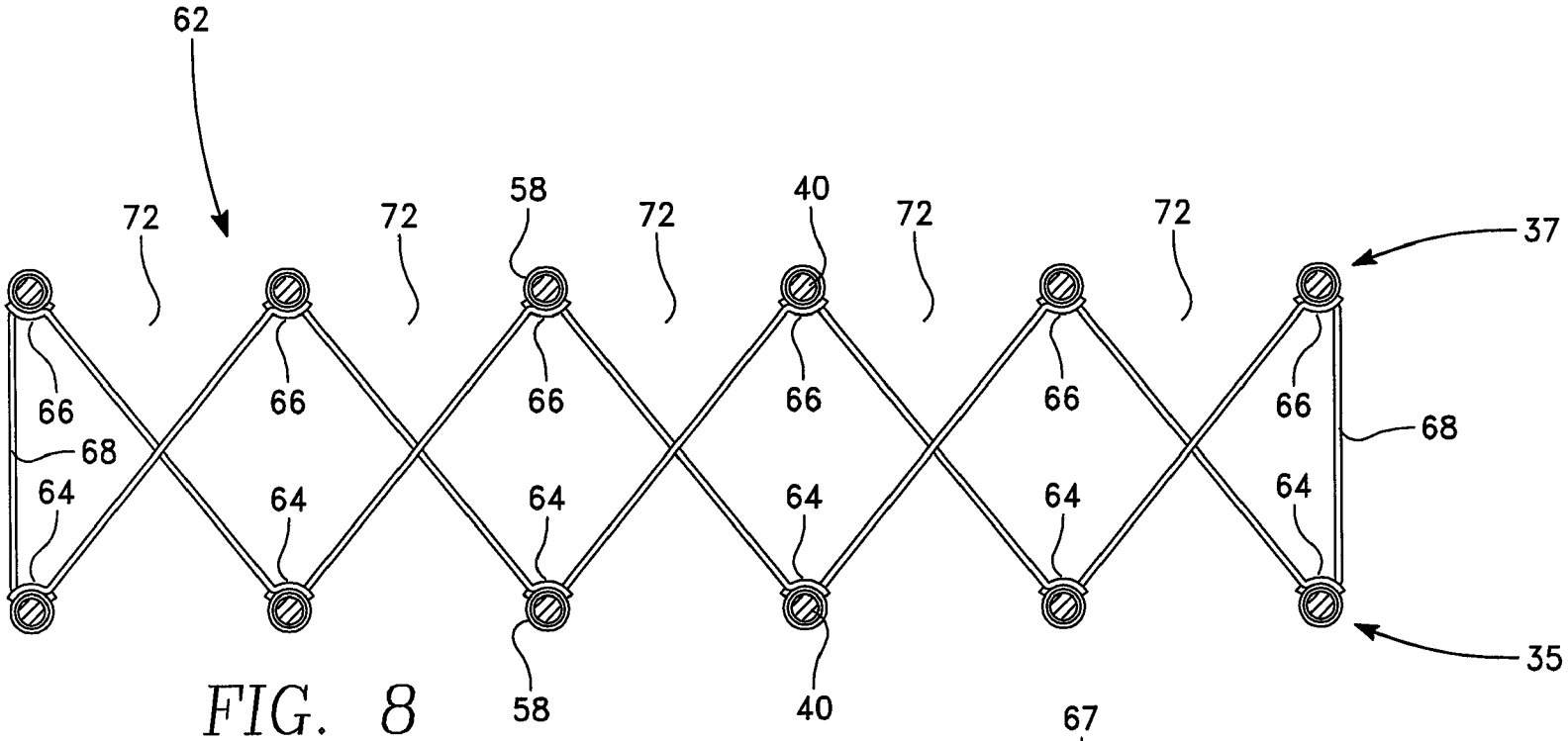
FIG. 8 schematically shows the configuration of one embodiment of a position retention means, referred to hereinafter as a "lattice assembly," utilized to maintain the bolts within a bolt package in position with respect to one another.
Figure 9:
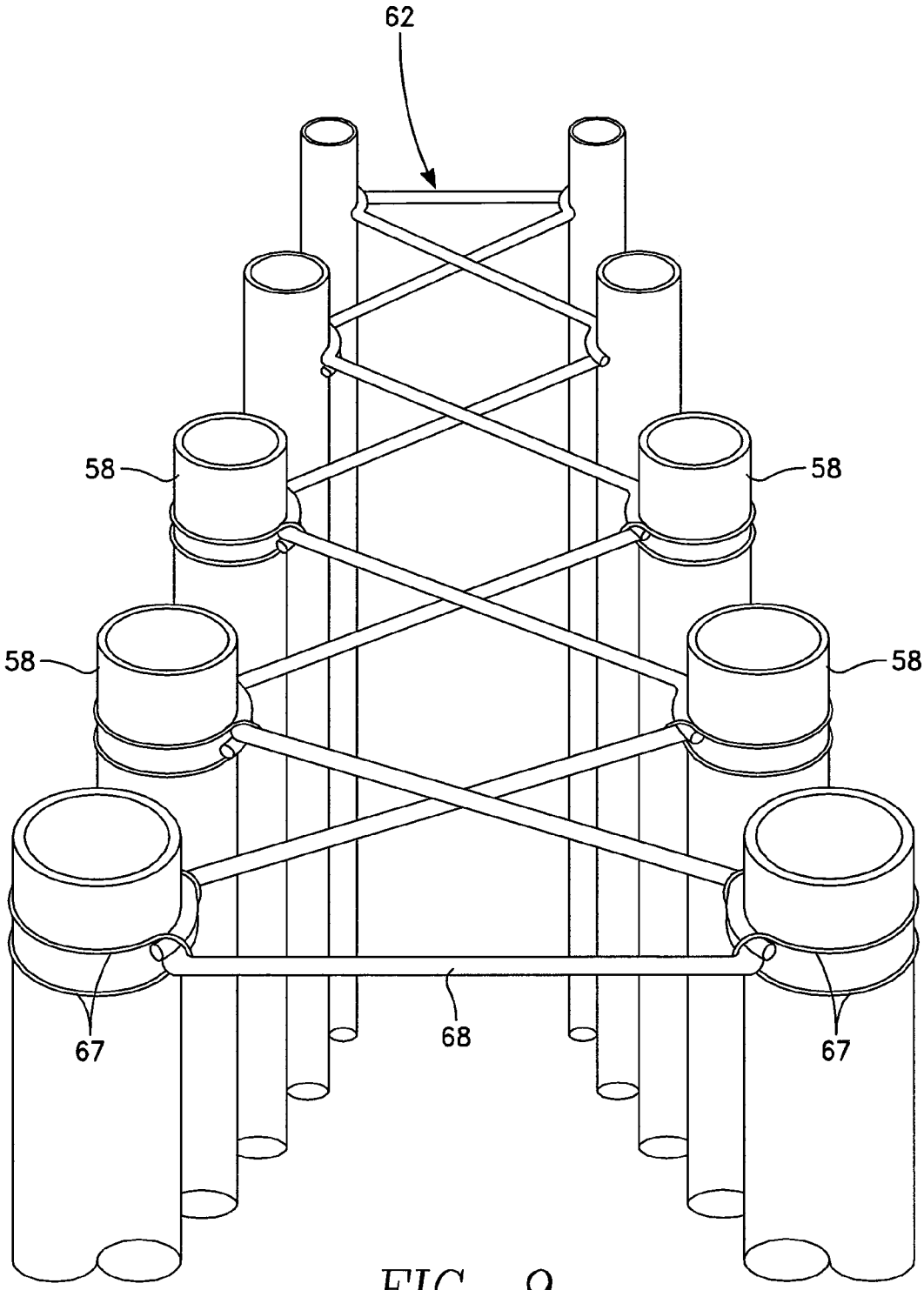
FIG. 9 shows a perspective view of an embodiment of a lattice assembly in accord with FIG. 8.
Figure 10:
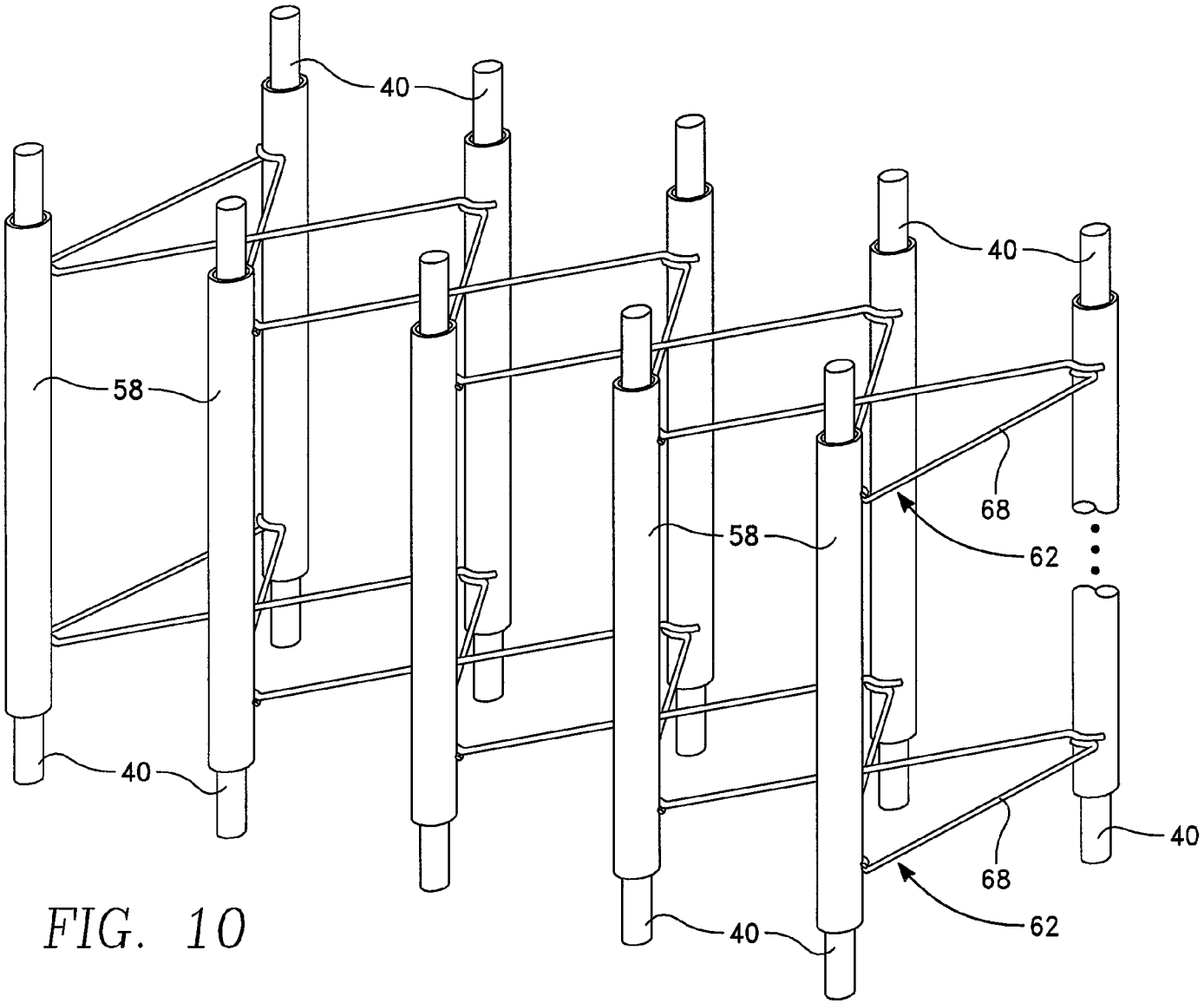
FIG. 10 shows the lattice assembly of FIG. 9 with bolts disposed within the bolt sleeves.
Figure 14:
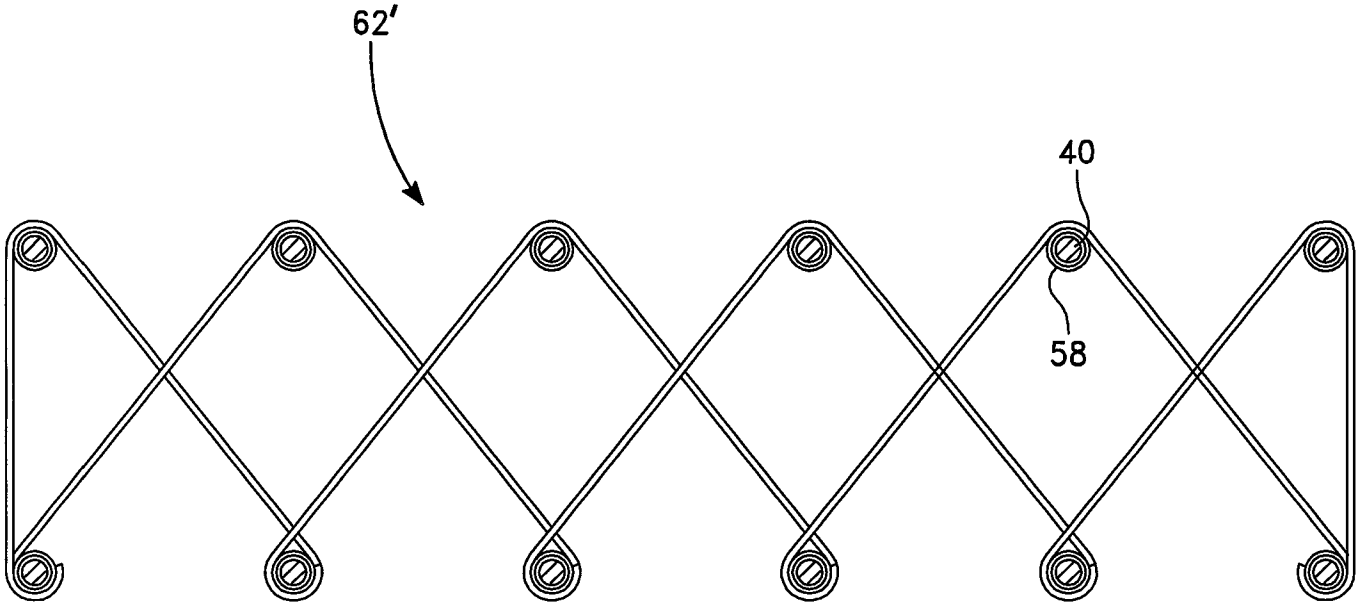
FIG. 14 shows an alternative embodiment of an alternative embodiment of a lattice assembly.
Figure 15:
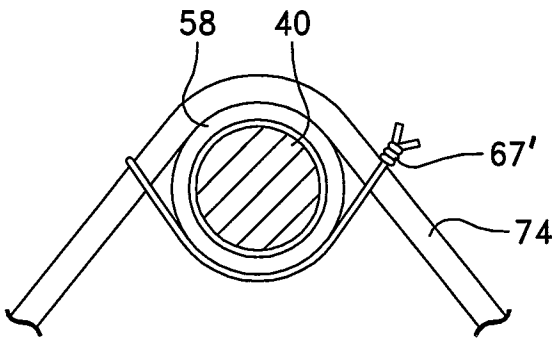
FIG. 15 shows a detailed view of how the embodiment of FIG. 14 may be attached to a bolt sleeve.
Figure 16:
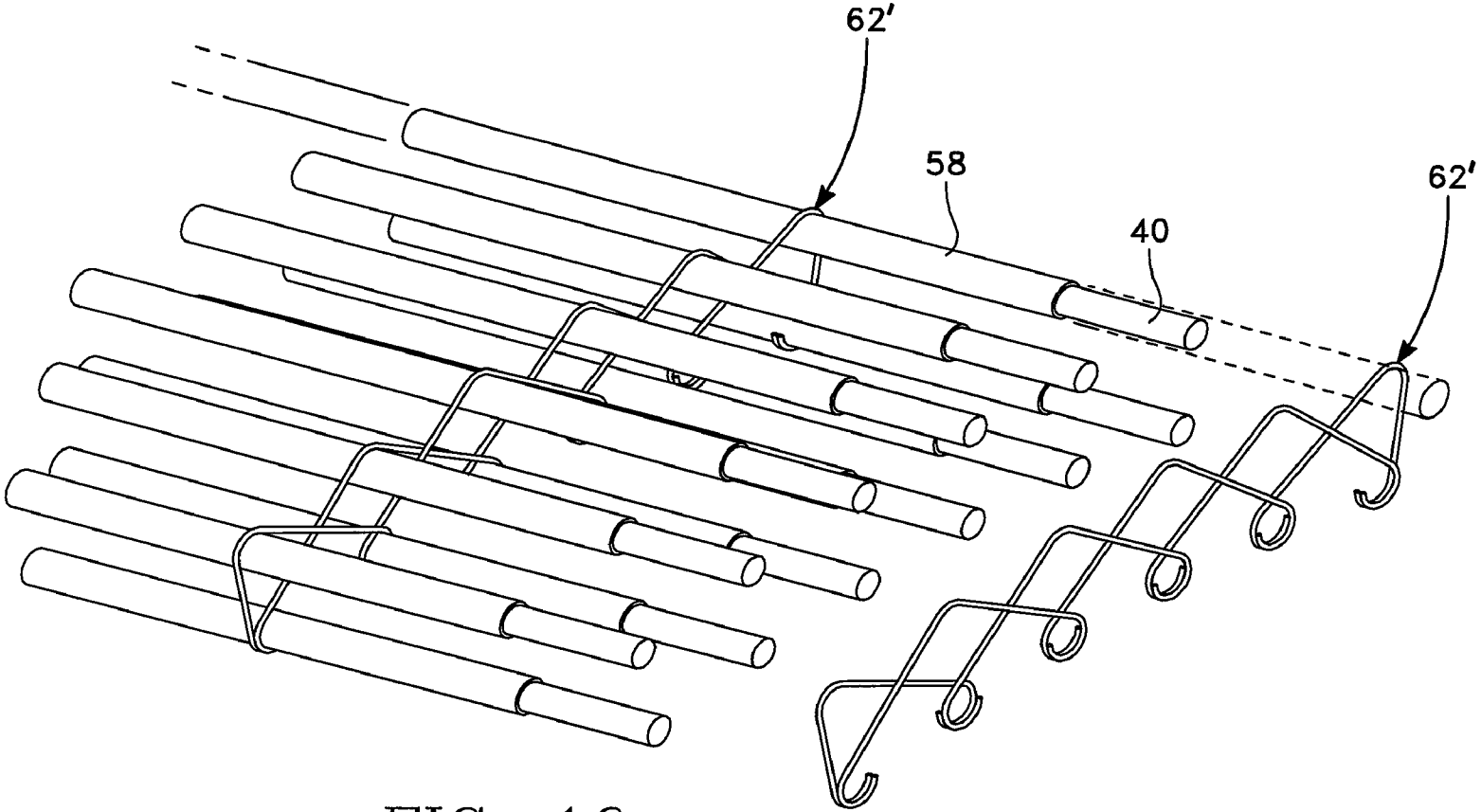
FIG. 16 shows the embodiment of lattice assembly shown in FIG. 14 may be attached to the bolt sleeves of a bolt package.

The bolt packages 50 are formed by dividing the total number of anchor bolts 40 to be installed in the foundation bore hole into a plurality of groups. Each bolt package 50 is made up of a number of individual bolts 40. Typically, each bolt package 50 will have ten to twelve (and typically no more than twenty) individual bolts 40 which are placed in axial alignment with one another and are configured into an inner arc 52 and an outer arc 54 of bolts. Each bolt 40 in the bolt package 50 is retained into a fixed position with respect to the position of the adjacent bolts by fixing the position of each bolt by position retention means. A first embodiment of position retention means is depicted in FIGS. 8-10 and a second embodiment is depicted in FIGS. 14-16. The position of each bolt 40 within the bolt package 50 with respect to the adjacent bolts in the package will be, with respect to the position of adjacent bolts, will be substantially the same position as when the bolt package is placed within the foundation bore hole 12 and when the bolt package 50 is placed in its final disposition within the foundation. As depicted in FIG. 6, each bolt package 50 is thereafter lowered into the bore hole 12 and arranged such that the inner arc 52 of bolts 40 of each anchor bolt package form an inner circle 18 of upwardly facing anchor bolts and the outer arc 54 of each bolt package form an outer circle 20 of upwardly facing anchor bolts as indicated by FIG. 7. As indicated by FIG. 6, a lifting plate 56 may be utilized for lifting and lowering the bolt package 50, but other means may also be utilized for lifting and lowering the bolt package as well, such that lifting plate 56 is optional.

Each bolt 40 contained within the bolt package 50 must be configured in such a manner as to allow tensioning of the bolt after it has been set in concrete 24. Usually this means each bolt 40 of the bolt package 50 will be contained within a bolt sleeve 58, where the bolt sleeves are typically elongated plastic tubes which encase the bolts substantially through the entire vertical extent of the concrete 24 and allow the bolts to be tensioned after the concrete has hardened and cured, thereby post-tensioning the entire concrete foundation. Alternatively, the bolts 40 can be wrapped in plastic tape, or coated with a suitable lubrication, which will allow the bolts to stretch under tension over the entire operating length of the bolt through the vertical extent of the concrete.

Each bolt package 50 further comprises an arc-shaped inbed plate 60 which is attached to what will be the downwardly facing ends of each bolt 40 when the bolt package is placed within the bore hole 12. A nut 70 is made up on each downward facing end of bolts 40 to attach the inbed plate 60 to the bolts. As discussed above, a lifting plate 56 may be likewise attached to the upwardly facing ends of each bolt 40, with sufficient nuts made up on the upwardly facing ends of the bolts to adequately secure the lifting plate to the bolt package 50. The lifting plate 56 may be installed temporarily to facilitate the lifting of the bolt package 50 from an assembly jig, such as assembly jig 100 described below, and for lowering the bolt package into the bore hole 12.

The bolt package 50 further comprises means for retaining the positions of each bolt 40 in the bolt package with respect to the other bolts in the bolt package as the bolt package is assembled and later lifted from the assembly jig 100 and lowered into the bore hole 12. One such means for setting the relative positions of the bolts 40 in a bolt package comprises a plurality of lattice assemblies 62, each lattice assembly fabricated as generally depicted in FIGS. 8-10. This embodiment of lattice assembly 62 may be fabricated utilizing robotic welding for rapid and precise fabrication. Three or more lattice assemblies 62 will typically be used in the assembly and installation of a single bolt package 50, where a lattice assembly is placed at various intervals along the lengths of the bolts 40. The utilization of the lattice assemblies 62 replaces the bands or rebar wraps of the known method, which are placed around the collective bolts to hold the bolts in position during the pouring of the concrete.

Figure 5:
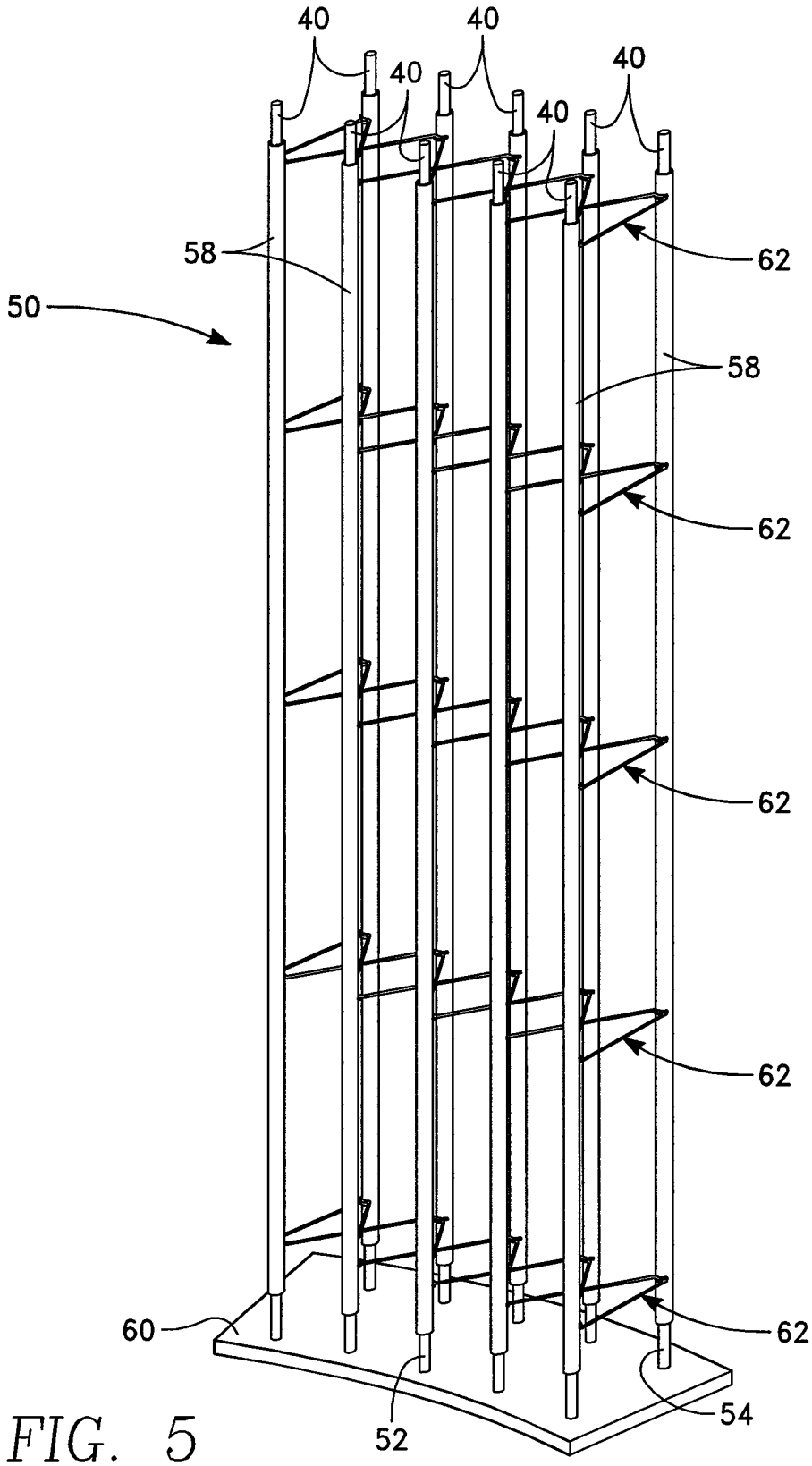
FIG. 5 depicts an embodiment of a bolt package in a vertical position as it would be when lowered into position.

FIG. 8 depicts how an embodiment of the lattice assembly 62 may be utilized for fabricating a bolt package 50. A lower group 35 of bolts 40, typically the bolts forming the inner arc 52, are placed in a horizontal position, with the bolts set within the desired arc configuration. It is to be appreciated that while arc configurations are not depicted in FIGS. 8-10, the bolts are arranged and retained together to form the required inner arc 52 and outer arc 54 as generally depicted in FIG. 5.

Figure 8A:
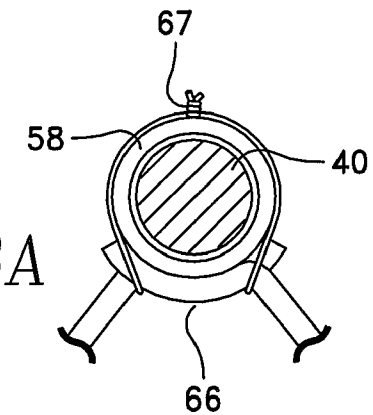
FIG. 8A shows a detailed view of how the lattice assembly in FIG. 8 may be attached to the bolt sleeves.
Figure 11A:
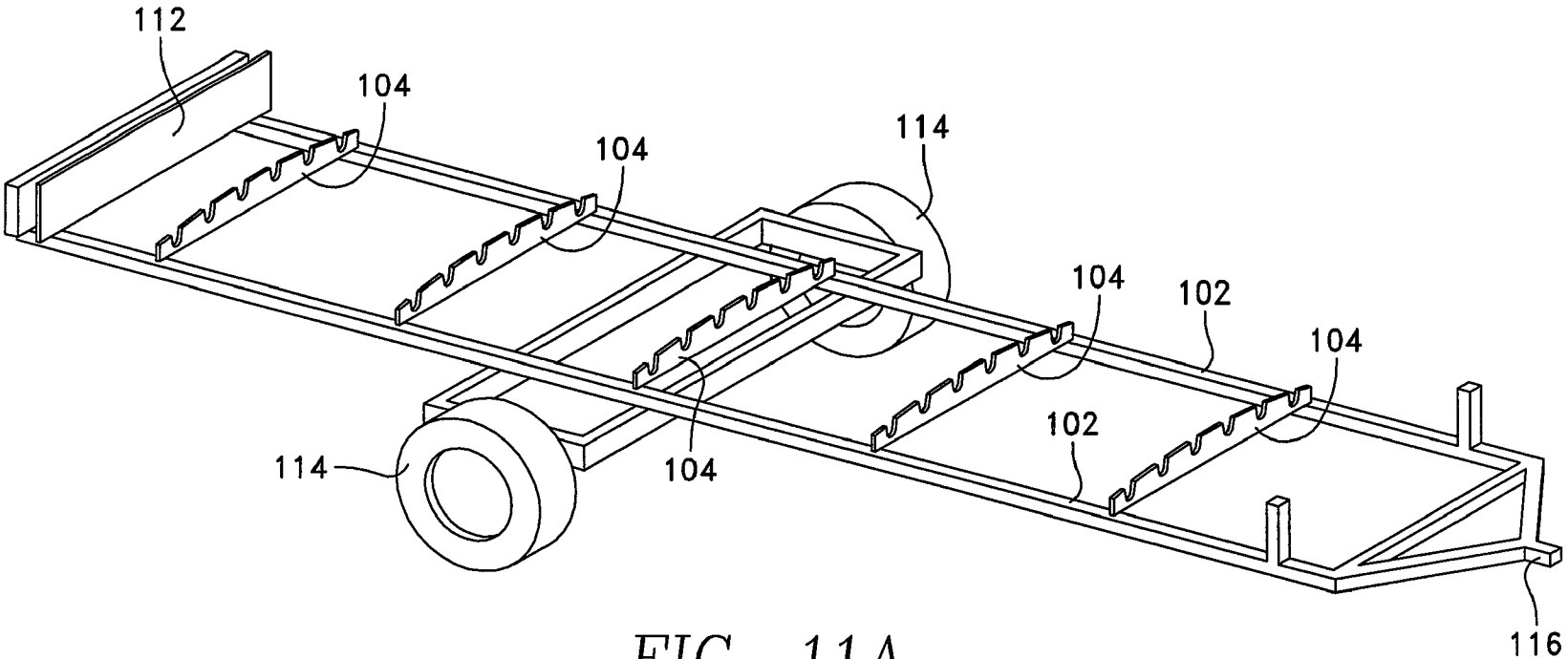
FIG. 11A shows a portable assembly jig which may be utilized for assembly and/or transport of bolt packages.
Figure 11B:
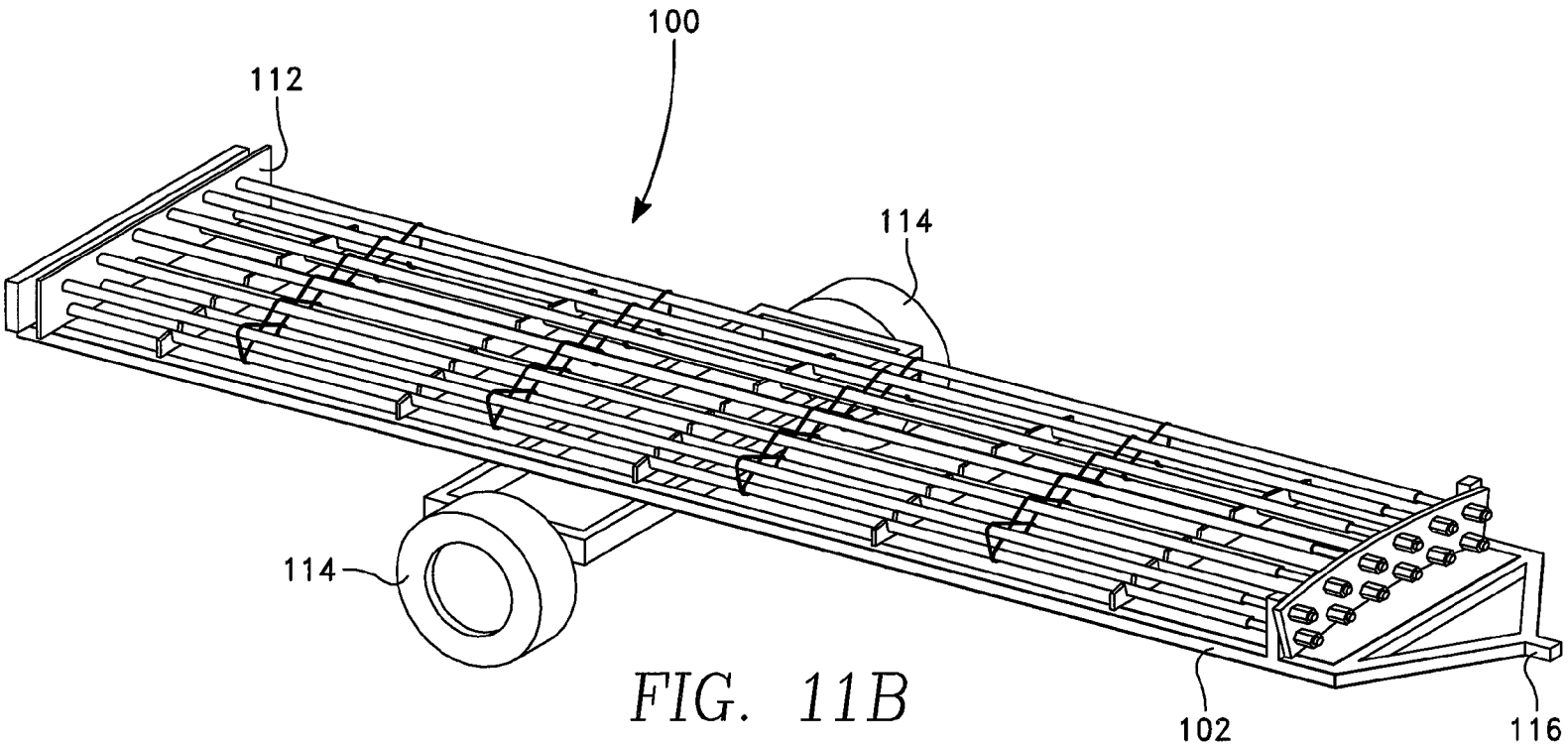
FIG. 11B shows the portable assembly jig of FIG. 11A with a bolt package disposed on the assembly jig.
Figure 12:
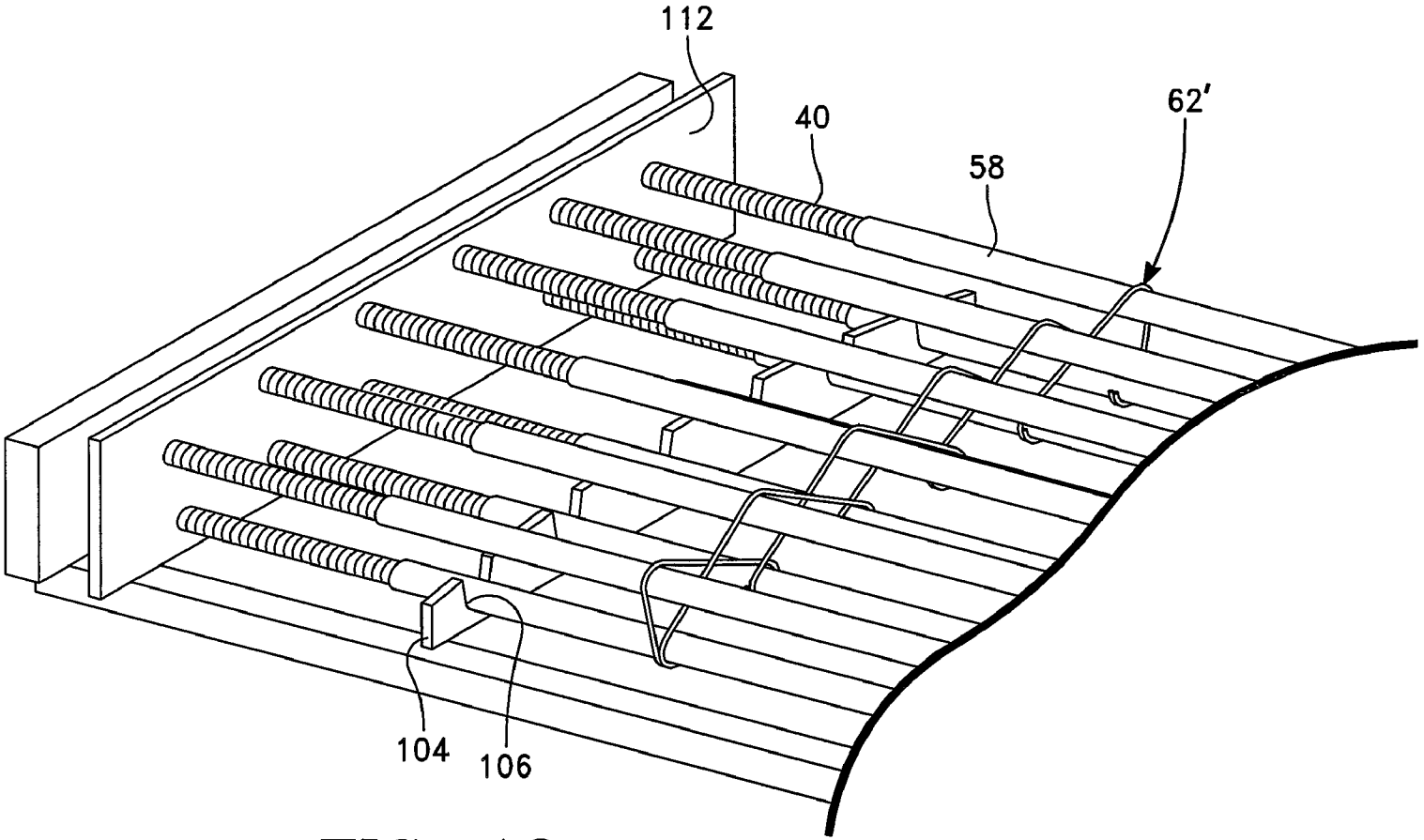
FIG. 12 shows a detailed view of a retention plate at one end of the assembly jig of FIG. 11.
Figure 13:
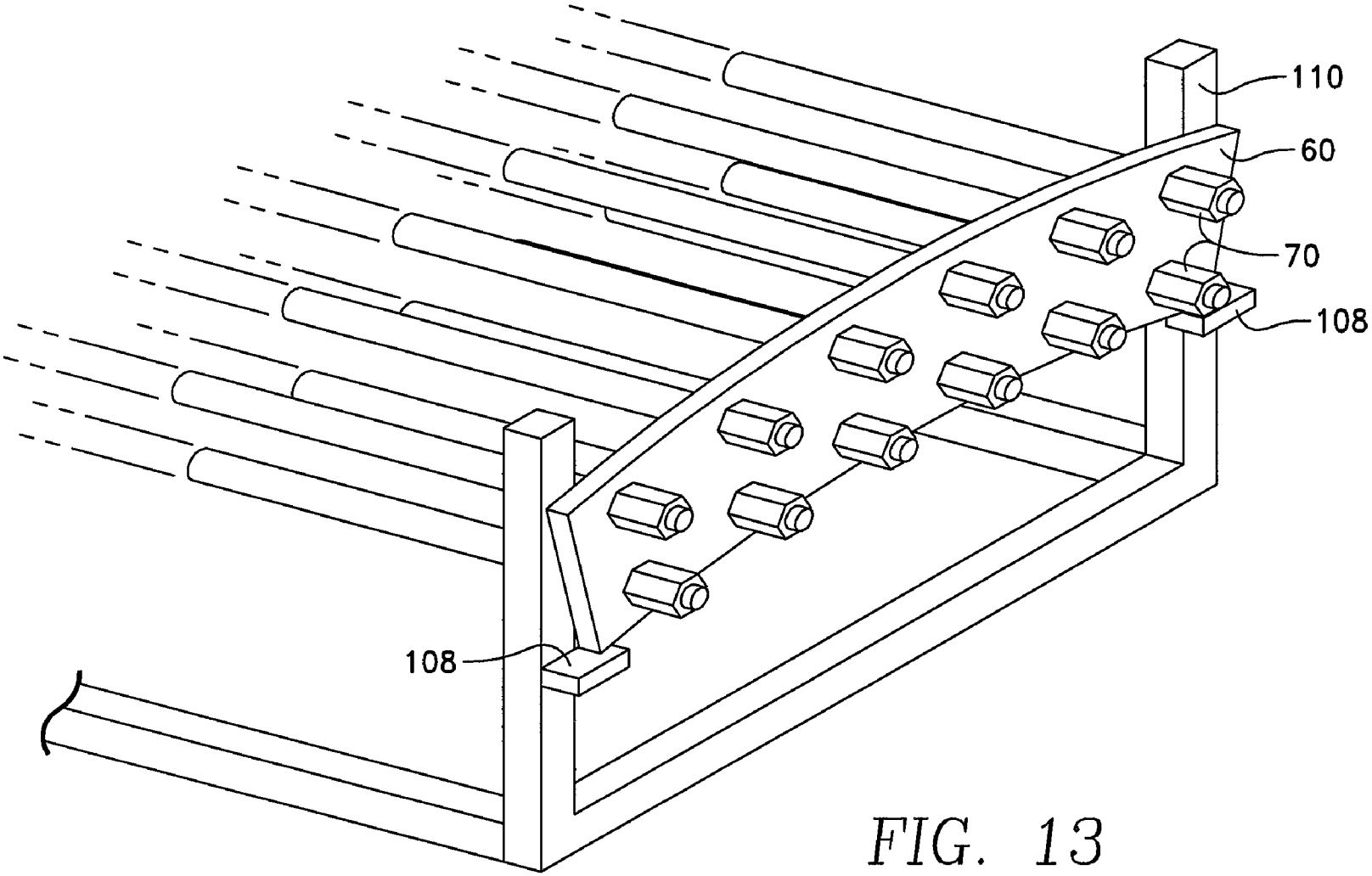
FIG. 13 shows how an inbed plate of a bolt package may be supported and retained within the assembly jig.
Figure 17:
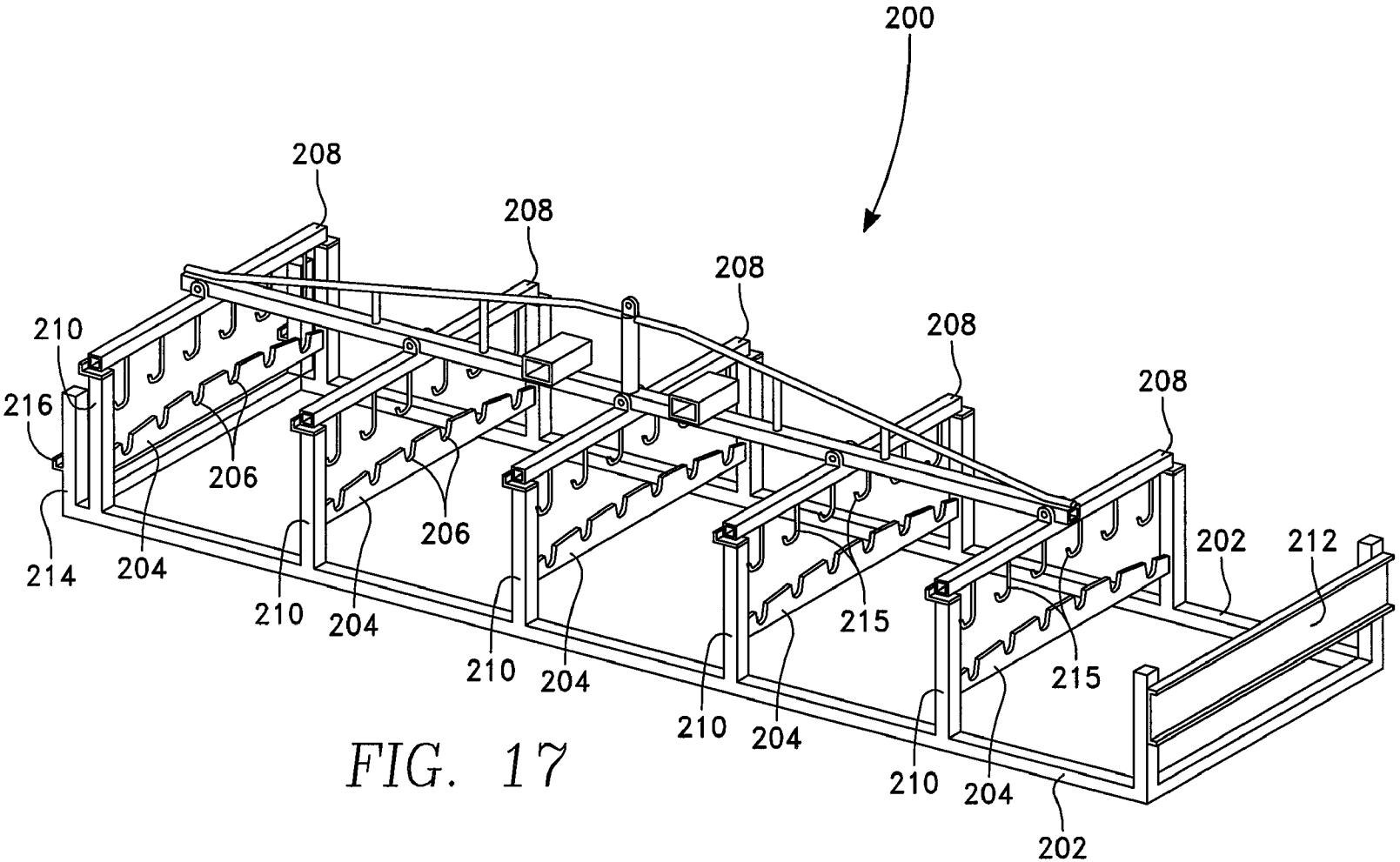
FIG. 17 shows an alternative embodiment of an assembly jig which may be utilized in assembling a bolt package with the embodiment of lattice assembly shown in FIGS. 14-16.
Figure 18:
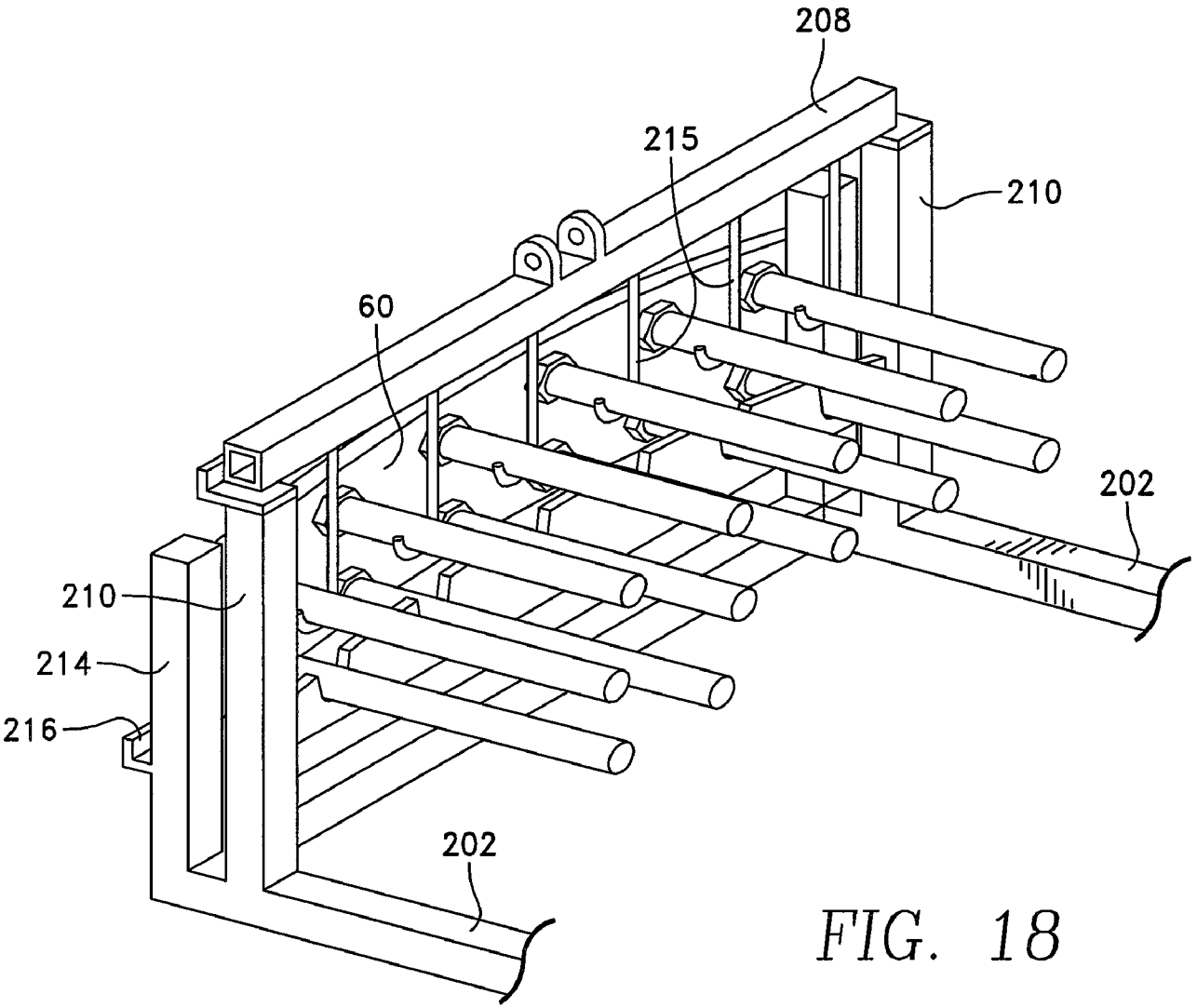
FIG. 18 shows how the assembly jig of FIG. 17 supports the bolts and bolt sleeves.
Figure 19:
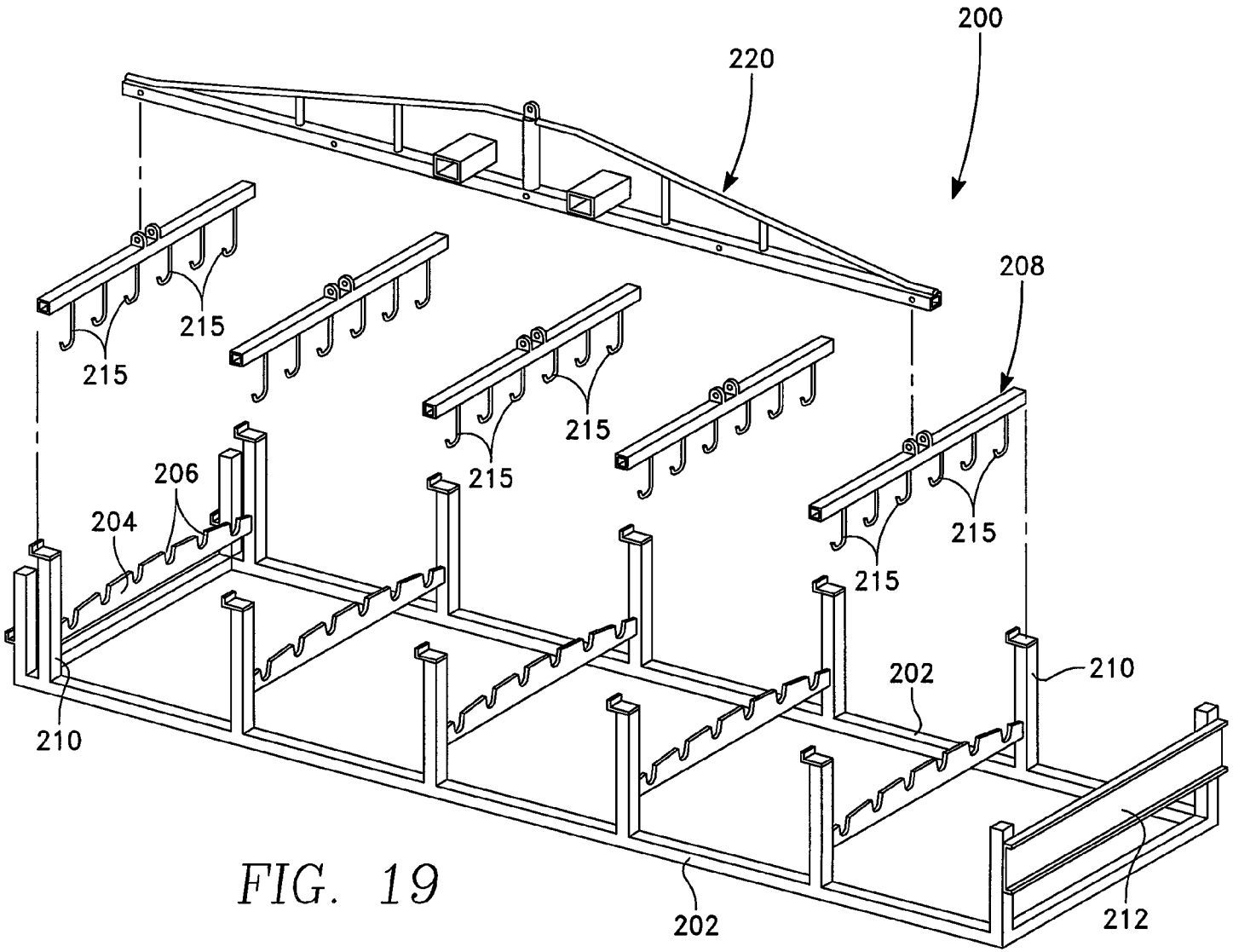
FIG. 19 shows the assembly jig of FIG. 17 in an exploded condition.

Setting the bolts 40 in the desired arc configuration is most conveniently obtained by utilizing a jig assembly 100 such as one similar to that shown in FIGS. 11-13 or to the jig assembly 200 shown in FIGS. 17-19. As shown in FIGS. 8-10, an embodiment of lattice assembly 62 may comprise a plurality of X-shaped members 72, each member having a pair of bolt engagement members 64 for engaging the bolts which, during assembly, are beneath the lattice assembly. For example, as indicated in FIG. 8, the bolts 40 forming the inner arc 52 may be placed in position first. Thereafter, a plurality of lattice assemblies are placed on top of the bolts 40 forming the inner arc 52, with the bolt engagement members 64 engaging the bolts. Each lattice assembly 62 further comprises a plurality of bolt support members 66 which support bolts 40 which may be placed on the support members 66 during assembly. If bolt sleeves 58 are utilized, the bolt engagement members 64 and the bolt support members 66 are each configured to engage the bolt sleeves which encases the body of each bolt 40. Means for attaching the bolt engagement members 64 and the bolt support members 66 to the bolts 40 are utilized to retain the bolts 40 to the lattice assemblies 62, such as wire, clips, or other suitable attachment means such as attachment wires 67 shown in FIG. 8A. The lattice assembly 62 may further comprise supplemental support members 68 which provide additional rigidity to the lattice assembly.

FIGS. 11 through 13 depict an assembly jig 100 which may be utilized when fabricating bolt packages 50 utilizing lattice assembly 62, or similar embodiments. It is to be appreciated that because of the configuration of lattice assembly 62, once the position of the bolts 40 forming the inner arc 52 (or, conversely the outer arc 54) are placed within the jig, the rigid construction of the lattice assemblies fixes the position of the bolts 40 forming the outer arc 54 (or conversely the inner arc 52).

Assembly jig 100 comprises a frame work of sufficient structural capacity to support the weight of an assembled bolt package 50. Each bolt package 50 is assembled on the assembly jig 100 with the bolts 40, typically within a bolt sleeve 58, consecutively laid horizontally across the frame work. The inner arc 52 of bolts is usually placed in the assembly jig 100 first, however it is to be appreciated that the assembly jig may be configured such that the outer arc 54 of bolts is laid in first. The assembly jig 100 comprises at least two parallel rails 102, and a plurality of arc-shaped cross-supports 104 disposed between the parallel rails. The cross-supports 104 are configured to have the same arc configuration (i.e., having the same degree) as the desired arc of the inner arc 52. Each cross-support 104 comprises a support seat 106 which is adapted to engage and support the underside of each bolt 40 (which may be enclosed within a bolt sleeve 58) as each bolt is laid across the lower cross-support. The bolt support seats 106 are configured to set the relative positions of the bolts 40 which will comprise an inner arc 52 which will, when the foundation construction is completed, will form the inner ring 18 of bolts. The bolt support seats 106 retain the bolts 40 in the proper relative position as the bolt package 50 is assembled. As shown in FIG. 13, an embodiment of the assembly jig 100 may comprise supports 108 placed on posts 110, at one end for retaining the inbed plate 60 at the proper position. The assembly jig 100 may also comprise an end plate 112 at the opposite end, which provides a positive stop for proper positioning of the bolts 40. As bolts 40 are set within the assembly jig 100, the inbed plate 60 is retained by the supports 108 and posts 110 while the opposite ends of the bolts are abutted against the end plate 112, which causes all of the bolts in the bolt package 40 to be aligned at each end. The assembly jig 100 may further comprise wheels 114 and a hitch 116 to allow the assembly jig to be easily transported to the construction site and allow assembly of bolt packages 50 at the on site of the installation.

It is to be appreciated that other means may be utilized for retaining the positions of each bolt 40 in the bolt package 50 with respect to the other bolts in the bolt package as the bolt package is assembled and lowered into the bore hole 12. For example, another embodiment of lattice assembly 62' is configured from bar stock 74, such as steel rebar, configured to wrap around the adjacent bolt bodies as shown in FIGS. 14-16. As with other embodiments of lattice assembly, the embodiments of lattice assembly 62' made with bar stock 74 will be configured to engage the bolts 40, or bolt sleeves 58, in several locations along the length of each bolt. As with the lattice assembly 62 depicted in FIGS. 8-10, the embodiment of a lattice assembly 62' shown in FIGS. 14-16 may be attached to each bolt 40 or bolt sleeve 58 with wire 67'. As indicated in FIG. 16, this embodiment of lattice assembly 62' may be prefabricated prior to installation upon a group of bolt sleeves 58 and/or bolts 40. Alternatively, this embodiment of lattice assembly 62' may be fabricated as bolts are positioned within a jig assembly. If the lattice assembly is not utilized to provide a support for the upper layer of bolts in the manner shown in FIGS. 8-10, it is necessary to utilize a jig assembly 200 such as that depicted in FIG. 17 to assemble the bolt packages 50. This jig assembly comprises at least two parallel rails 202, and a plurality of arc-shaped lower cross-supports 204 disposed between the parallel rails. The lower cross-supports 204 are configured to have the same arc configuration (i.e., having the same degree) as the desired arc of the inner arc 52 of bolts 40. Each lower cross-support 204 comprises a support seat 206 which is adapted to engage and support the underside of each bolt 40 (which may be enclosed within a bolt sleeve 58) as each bolt is laid across the lower cross-support. The bolt support seats 206 are configured to set the relative positions of the bolts 40 which will comprise an inner arc 52 which will, when the foundation construction is completed, will form the inner ring 18 of bolts. The bolt support seats 206 retain the bolts 40 in the proper relative position as the bolt package 50 is assembled.

The jig assembly 200 shown in FIGS. 17-19 further comprises a plurality of upper cross-supports 208 disposed between posts 210 which extend upwardly from parallel rails 202. Each upper cross-support 208 comprises a plurality of hangers 215 which support the bolts 40 which will form the outer arc 54. Jig assembly 200 further comprises an end plate 212 at one end which provides a positive stop for proper positioning of the bolts 40. Jig assembly 200 further comprises posts 214 and supports 216 which support inbed plate 60.

As best shown in the exploded view in FIG. 19, jig assembly 200 may further comprise a lifting assembly 220 which allows either the transport of the jig assembly 200 or the lifting of the bolt package 50 from the lower portion of the jig assembly 200. Lifting assembly may either be lifted by crane or fork lift.

Once all of the bolt packages 50 are installed within the bore hole 12, unless designed otherwise, the arcs of the adjacently positioned inbed plates 60 will form a complete circle forming the lower anchor ring, with each inbed plate of a bolt package attached to the inbed plates of the two adjacent bolt packages. In a similar manner, as best shown in FIG. 7, arc-shaped sections are connected to form template member 34'.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following appended claims.

I claim:

1. A method of installing tower flange anchor bolts in a wind turbine foundation comprising the following steps:

preparing a foundation bore hole;

dividing the total number of tower flange anchor bolts to be installed in the foundation bore hole into a plurality of groups;

assembling a first anchor bolt package comprising bolts from a first group, wherein the first anchor bolt package comprises a plurality of axially aligned bolts configured to form an inner arc of bolts and an outer arc of bolts, wherein each bolt is retained, by position retention means, in a position, with respect to the position of adjacent bolts, which is substantially the same position as when the first bolt package is placed within the foundation bore hole;

assembling additional anchor bolt packages wherein each additional anchor bolt package comprises a similar configuration as the first anchor bolt package until the total number of anchor bolts to be installed are contained within an anchor bolt package; and lowering each anchor bolt package into the bore hole and arranged such that the inner arc of bolts of each anchor bolt package form an inner circle of upwardly facing anchor bolts and the outer arc of each bolt package form an outer circle of upwardly facing anchor bolts.

2. The method of claim 1 wherein each bolt of each bolt package is contained within a tube.

3. The method of claim 1 wherein each anchor bolt comprises a downwardly facing end and an upwardly facing end, and an arc-shaped in-bed plate is placed on the downwardly facing ends of the anchor bolts of each anchor bolt package.

4. The method of claim 3 wherein a lifting plate is placed on the upwardly facing ends of the anchor bolts of each anchor bolt package.

5. The method of claim 1 wherein the position retention means comprises a plurality of lattice assemblies, wherein the lattice assemblies are disposed at intervals along the lengths of the anchor bolts.

6. The method of claim 5 wherein each lattice assembly comprises a plurality of x-shaped supports, each x-shaped support disposed between four adjacent anchor bolts.

7. The method of claim 5 wherein each lattice assembly comprises steel rebar configured to wrap around adjacent anchor bolts.

8. The method of claim 1 wherein the anchor bolt packages are assembled on an assembly jig.

9. The method of claim 8 wherein the assembly jig comprises at least two parallel rails and a plurality of cross-supports disposed between the parallel rails for supporting the inner arc of bolts.

10. The method of claim 9 wherein the assembly jig comprises a plurality of upwardly extending posts attached to the parallel rails, and a plurality of upper cross-supports each spanning between a pair of upwardly extending posts, the upper cross-supports comprising a plurality of hangers attached thereto for supporting the outer arc of bolts.

11. In a foundation for a wind turbine, the foundation comprising a plurality of anchor bolts axially disposed within a bore hole for mounting a tower flange of the wind turbine, a pre-assembled bolt package comprises:

a maximum of twenty anchor bolts in axial alignment with each other, the anchor bolts configured to form an inner arc of bolts and an outer arc of bolts, wherein each bolt is retained, by position retention means, in a fixed position with respect to the position of the other anchor bolts in the pre-assembled package.

12. The pre-assembled bolt package of claim 11 wherein each anchor bolt is contained within a tube.

13. The pre-assembled bolt package of claim 11 wherein each anchor bolt comprises, with respect to the bore hole, a downwardly facing end and an upwardly facing end, and an arc-shaped in-bed plate is placed on the downwardly facing ends of the anchor bolts.

14. The pre-assembled bolt package of claim 13 wherein a lifting plate is placed on the upwardly facing ends of the anchor bolts of each anchor bolt package.

15. The pre-assembled bolt package of claim 11 wherein the position retention means comprises a plurality of lattice assemblies, wherein the lattice assemblies are disposed at intervals along the lengths of the anchor bolts.

16. The pre-assembled bolt package of claim 15 wherein each lattice assembly comprises a plurality of x-shaped supports, each x-shaped support disposed between four adjacent anchor bolts.

17. The pre-assembled bolt package of claim 15 wherein each lattice assembly comprises steel rebar configured to wrap around adjacent anchor bolts.

18. In a foundation for a wind turbine, the foundation comprising a plurality of anchor bolts axially disposed within a bore hole for mounting a tower flange of the wind turbine, wherein the plurality of anchor bolts comprise a plurality of pre-assembled bolt packages comprising a maximum of twenty anchor bolts in axial alignment with each other, the anchor bolts of each pre-assembled bolt package are configured to form an inner arc of bolts and an outer arc of bolts, wherein each bolt is retained, by position retention means, in a fixed position with respect to the position of the other anchor bolts in the pre-assembled package, an assembly jig for fabricating the pre-assembled bolt package comprises:

at least two parallel rails and a plurality of lower cross-supports disposed between the parallel rails for supporting the inner arc of bolts.

19. The assembly jig of claim 18 further comprising a plurality of upwardly extending posts attached to the parallel rails, wherein a plurality of upward cross-supports are attached to the upwardly extending posts for supporting the outer arc of bolts.

20. The assembly jig of claim 19 wherein each of the upper cross-supports comprises a plurality of hangers adapted to support an individual bolt.

* * * * *